United States Patent [19]

Rushforth

[11] 4,301,857

[45] Nov. 24, 1981

[54] OSCILLATING MOLD CASTING APPARATUS

[75] Inventor: Calvin Rushforth, Andover, Mass.

[73] Assignee: Kennecott Corporation, Stamford, Conn.

[21] Appl. No.: 117,028

[22] Filed: Jan. 31, 1980

[51] Int. Cl.[3] ..... B22D 11/04

[52] U.S. Cl. ..... 164/416; 164/439

[58] Field of Search ..... 164/82, 83, 416, 439

[56] References Cited

U.S. PATENT DOCUMENTS

| | | | |
|---|---|---|---|
| 1,088,171 | 2/1914 | Pearson | 164/416 |
| 2,135,183 | 11/1938 | Junghans | 164/83 |
| 2,135,184 | 11/1938 | Junghans | 164/416 |
| 2,405,355 | 8/1946 | Harrison | 164/83 X |
| 3,300,824 | 1/1967 | Ross | 164/83 |
| 3,302,252 | 2/1967 | Woodburn | 164/416 |
| 3,410,333 | 11/1968 | Woodburn | 164/83 |
| 3,638,714 | 2/1972 | Newhall et al. | 164/416 X |
| 3,746,077 | 7/1973 | Lohikoski et al. | 164/416 |
| 3,782,446 | 1/1974 | Walter | 164/416 |
| 3,872,913 | 3/1975 | Lohikoski | 164/64 |
| 3,881,544 | 5/1975 | Botta et al. | 164/416 |
| 3,893,502 | 7/1975 | Slamar | 164/4 |
| 4,211,270 | 7/1980 | Shinopulos et al. | 164/83 |

FOREIGN PATENT DOCUMENTS

| | | | |
|---|---|---|---|
| 871044 | 5/1971 | Canada | 164/416 |
| 969731 | 6/1975 | Canada . | |
| 2447863 | 5/1975 | Fed. Rep. of Germany | 164/416 |
| 933874 | 8/1963 | United Kingdom | 164/416 |
| 935046 | 8/1963 | United Kingdom | 164/83 |

OTHER PUBLICATIONS

"Rolling of Bar, Rod, and Section: Copper and Copper Alloys", W. Schmitz-Steger, Metals Technology, Jul.-Aug. 1975, pp. 382-395.

*Primary Examiner*—Robert D. Baldwin

*Attorney, Agent, or Firm*—Anthony M. Lorusso; R. Lawrence Sahr

[57] ABSTRACT

An oscillating cooled mold assembly for the continuous, high-speed casting of metallic strands or rods, especially upcasting strands or rods of copper alloys such as brass, has a hollow die in fluid communication with a melt typically held in a casting furnace. A cooler body surrounds the die in a tight-fitting relationship to form a solidification front in the melt as it advances through the casting zone of the die. The strand or rod formed from the solidified melt is pulled through the die while the mold oscillates in a direction substantially parallel to the direction of travel of the rod.

47 Claims, 12 Drawing Figures

OSCILLATING MOLD CASTING APPARATUS

BACKGROUND OF THE INVENTION

This invention relates to an apparatus for the continuous casting of metal rod or strands and more particularly to a casting apparatus in which the cooled casting mold oscillates back and forth while the rod or strand continuously advances through the cooled casting mold as it forms.

It is well known in the art to cast indefinite lengths of metallic strands from a melt by drawing the melt through a cooled mold. The mold generally has a die of a refractory material such as graphite cooled by a surrounding water jacket. U.S. Pat. No. 3,354,936 for example, describes a cooled mold assembly sealed into the bottom wall of the melt container to downcast large billets. The force of gravity feeds the melt through the mold. In downcasting, however, there is a danger of a melt "break out" and the melt container must be emptied or tilted to repair or replace the mold or the casting die.

Horizontal casting through a chilled mold has also been practiced. Besides the break out and replacement problems of downcasting, gravity can cause a non-uniform solidification resulting in a casting that is not cross-sectionally uniform or having an inferior surface quality.

Various arrangements have been used for upcasting. Early efforts are described in U.S. Pat. No. 2,553,921 to Jordan and U.S. Pat. No. 2,171,132 to Simons. Jordan employs a water cooled, metallic "mold pipe" with an outer ceramic lining that is immersed in a melt. In practice, no suitable metal has been found for the mold pipe, the casting suffers from uneven cooling, and condensed metallic vapors can collect in a gap between the mold pipe and the liner due to differences in their coefficients of thermal expansion. Simons also used a watercooled "casing"; but, it is mounted above the melt; and, a vacuum is required to draw melt up to the casing. A coaxial refractory extension of the casing extends into the melt. The refractory extension is necessary to prevent "mushrooming", that is, the formation of a solid mass of the metal with a diameter larger than that of the cooled casing. As with Jordan, thermally generated gaps, in this instance between the casing and the extension, can collect condensed metal vapors which results in poor surface quality or termination of the casting.

U.S. Pat. Nos. 3,746,077 and 3,872,913 describe more recent upcasting apparatus and techniques. The '913 patent avoids problems associated with thermal expansion by placing only the tip of a "nozzle" in the melt. A water-cooled jacket encloses the upper end of the nozzle. Because the surface of the melt is below the cooling zone, a vacuum chamber at the upper end of the nozzle is necessary to draw the melt upwardly to the cooling zone. The use of the vacuum chamber however limits the rate of strand withdrawal and requires a seal.

The '077 patent avoids the vacuum chamber by immersing a cooling jacket and a portion of an enclosed nozzle into the melt. The immersion depth is sufficient to feed melt to the solidification zone, but it is not deeply immersed. The jacket as well as the interface between the jacket and the nozzle are protected against the melt by a surrounding insulating lining. The lower end of the lining abuts the lower outer surface of the nozzle to block a direct flow of the melt to the cooling jacket.

The foregoing systems are commonly characterized as "closed" mold in that the liquid metal communicates directly with the solidification front. The cooled mold is typically fed from an adjoining container filled with the melt. In contrast, an "open" mold system feeds the melt, typically by a delivery tube, directly to a mold where it is cooled very rapidly. Open mold systems are commonly used in downcasting large billets of steel, and occasionally aluminum, copper or brass. However, open mold casting is not used to form products with a small cross section because it is very difficult to control the liquid level and hence the location of the solidification front.

A problem that arises in closed mold casting is a thermal expansion of the bore of the casting die between the beginning of the solidification front and the point of complete solidification (termed "bell-mouthing"). This condition results in the formation of enlargements of the casting cross section which wedge against a narrower portion of the die. The wedged section can break off and form an immobile "skull". The skulls can either cause the strand to terminate or can lodge on the die and produce surface defects on the casting. Therefore it is important to maintain the dimensional uniformity of the die bore within the casting zone. In the '913 and '077 systems, these problems are controlled by a relatively gentle vertical temperature gradient along the nozzle due in part to a modest cooling rate to produce a generally non-bellmouthed surface solidification front. With this gentle gradient, acceptable quality castings can be produced only at a relatively slow rate, typically five to forty inches per minute.

Another significant problem in casting through a chilled mold is the condensation of metallic vapors. Condensation is especially troublesome in the casting of brass bearing zinc or other alloys bearing elements which boil at temperatures below the melting temperature of the alloy. Zinc vapor readily penetrates the materials commonly used to form casting dies as well as the usual insulating materials and can condense to liquid in critical regions. Liquid zinc on the die near the solidification front can boil at the surface of the casting resulting in a gassy surface defect. Because of these problems, present casting apparatus and techniques are not capable of commercial production of good quality brass strands at high speeds.

The manner in which the casting is drawn through the chilled mold is also an important aspect of the casting process. A cycled pattern of a forward withdrawal stroke followed by a dwell period is used commercially in conjunction with the mold unit described in the aforementioned U.S. Pat. No. 3,872,913. U.S. Pat. No. 3,908,747 discloses a controlled reverse stroke to form the casting skin, prevent termination of the casting, and compensate for contraction of the casting within the die as it cools. British Pat. No. 1,087,026 also discloses a reverse stroke to partially remelt the casting. U.S. Pat. No. 3,354,936 discloses a pattern of relatively long forward strokes followed by periods where the casting motion is stopped and reversed for a relatively short stroke. This pattern is used in downcasting large billets to prevent inverse segregation. In all of these systems, however, the stroke velocities and net casting velocities are slow. In the '936 system, for example, forward strokes are three to twenty seconds in duration, reverse strokes are one second in duration, and the net velocity is thirteen to fifteen inches per minute.

It is known to oscillate a continuous casting mold to provide stripping action to facilitate the movement of the newly cast rod through the mold and more importantly, when the rate of advancement of the mold during a portion of the cycle is greater than that of the rod being cast, to prevent tension tears in the solidifying skin. Moreover, creating the casting strokes by mold oscillation allows the rod to be withdrawn from the mold at a constant rate thereby facilitating further processing operations after casting, for example, the conversion of rod to strip.

Mold movement, however, introduces problems not associated with stationary mold casting machines. For example, to cause rod solidification, coolant must be circulated continuously through the mold assembly. However, with an oscillating mold, coolant circulation must occur as the mold oscillates. Furthermore, to produce high quality rod, it is necessary that mold motion be substantially parallel to the direction of travel of the rod through the mold. For upcasting this criterion requires that mold oscillation during strand solidification be linear and in the vertical direction with little or no lateral movement. Furthermore, for high performance, mold assemblies must be reciprocated at high velocities and accelerations. Because mold assemblies are relatively heavy, mechanical stresses result that make it difficult to attain substantially vertical mold motion. Additionally, resonant coupling of mold assembly oscillation with the vibratory modes of the mold supporting structure and the natural frequencies of the hydraulic system is difficult to eliminate with moving mold casting machines.

Unlike stationary mold casters in which the forward and reverse strokes are created by reversing the rotation of the gripping rolls which move the cast strand, an oscillating mold caster reciprocates. Thus, the mold assembly continuously experiences hydrodynamic loading as it reciprocates within the furnace melt. Furthermore, the force of the acceleration (G) produced during oscillation is the major factor contributing to loading. Of course, loading exacerbates structural framing problems.

It is therefore an object of this invention to provide an oscillating mold casting apparatus for the production of high quality rod which is continuously cooled and which moves in substantially the same direction as the rod being cast with little or no lateral movement.

Another object of the invention is to provide an oscillating mold assembly configuration which minimizes loading during oscillation.

A still further object of the invention is to provide an oscillating mold caster of novel design which accommodates the inertial stresses associated with reciprocation within a melt.

Another object of this invention is to provide a mold assembly and method for the continuous casting of high quality metallic strands and particularly those of copper and copper alloys including brass at production speeds many times faster than those previously attainable with closed mold systems.

Another object of the invention is to provide such a cooled mold assembly for upcasting with the mold assembly oscillating and immersed in the melt.

A further object of the invention is to provide such a mold assembly that accommodates a steep temperature gradient along a casting die, particularly at the lower end of a solidification zone, without the formation of skulls or loss of dimensional uniformity in the casting zone.

Still another object of the invention is to provide a casting withdrawal process for use with such a mold assembly to produce high quality strands at exceptionally high speeds.

A further object of the invention is to provide a mold assembly with the foregoing advantages that has a relatively low cost of manufacture, is convenient to service and is durable.

SUMMARY OF THE INVENTION

The apparatus for the continuous casting of metal rod or strand according to the present invention comprises a chilled mold assembly for communication with a metallic melt and means for drawing the metallic melt through the mold assembly to effect solidification of a rod or strand. The mold assembly is supported for oscillation in a direction substantially parallel to the direction of travel of the rod through the mold, and the means by which the mold assembly is caused to oscillate, as the rod or strand advances, creates the effect of both forward and reverse casting strokes. By oscillating the mold while withdrawing the rod or strand at a constant velocity the relative motion between mold and rod is controllable over a wide range. Means are provided to deliver coolant to the chilled mold during oscillation.

In a preferred embodiment of the invention, the mold assembly comprises a mold or die surrounded by a coolerbody. A coolant manifold extension assembly communicates with and supplies coolant to the coolerbody. The manifold extension assembly in turn attaches to a support manifold which supplies the extension assembly with coolant. As insulating hat surrounds the coolerbody and manifold extension assembly, thermally insulating them from the metallic melt. The insulating hat attaches to the support manifold by spring biased mounting means. The manifold extension assembly features three concentric tubes forming two annular elongated passageways therebetween, with one of the annular passageways being adapted for supplying coolant to the coolerbody and the other passageway being adapted for receiving the coolant from the coolerbody. The two inner tubes fit slidably into O-ring gland seals in the support manifold.

The means for accomplishing mold oscillation includes at least one hydraulic actuator. In this embodiment the means for supporting the mold assembly for oscillation comprises a support structure having vibratory natural frequencies substantially higher than the natural frequency of the hydraulic system. To accommodate failures in the hydraulic system, means are provided for stopping the mold assembly nondestructively. It is preferred that hydraulic shock absorbers in combination with elastomeric bumpers be used to stop the mold assembly in the event of hydraulic system failure.

The hydraulic cylinder and mold motion is controlled by a servo valve and computer means. Mold oscillation wave forms can be shaped to provide unlimited variation in stripping velocity, return velocity and dwell. This is extremely useful in determining optimum mold motion programs for different casting alloys.

BRIEF DESCRIPTION OF THE DRAWINGS

The invention disclosed herein will be better understood with reference to the following drawings in which.

DESCRIPTION OF THE PREFERRED EMBODIMENT

Figure 1:
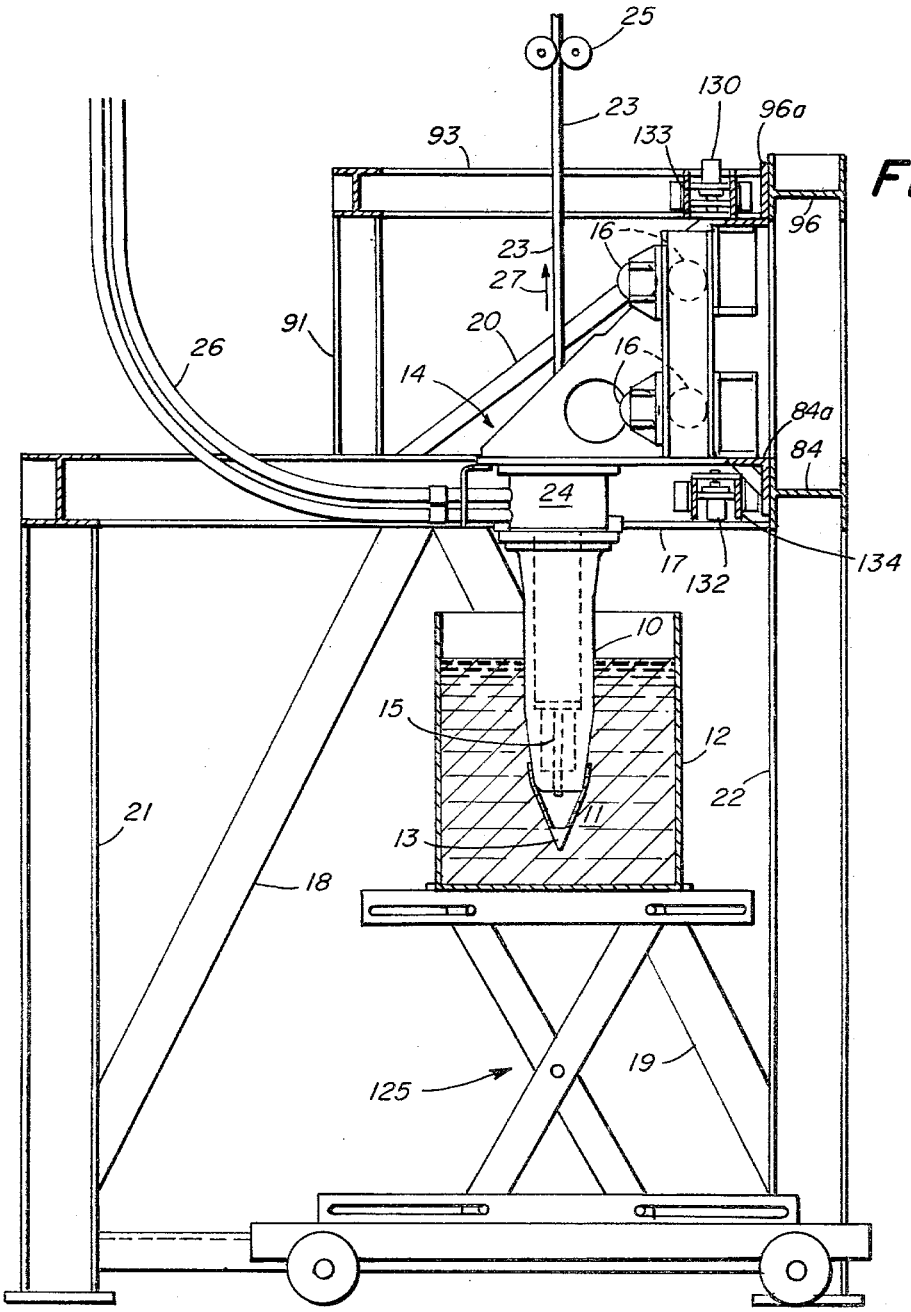
FIG. 1 is a side view partially in section of the oscillating mold and supporting structure according to the present invention in conjunction with a furnace for holding a melt.

At the outset, the invention is described in its broadest overall aspects with a more detailed description following. Corresponding parts will be designated by the same numbers throughout the figures. As is shown in FIG. 1, a mold assembly 10 is immersed in a melt 11 contained by a furnace 12. FIG. 1 shows a protective cone 13 which melts away after the assembly 10 is immersed in the melt 11. The protective cone 13 is normally formed of copper and takes less than one minute to completely melt away. The purpose of the protective cone is to prevent dross and other impurities from entering a die 15 upon immersion. Once the assembly is immersed in the melt and the cone has disintegrated, molten metal is drawn through the assembly 10. Initially, the process is started by inserting a solid starter rod (with a bolt on the end of it) through the die 15 from the upper part of the assembly into the melt. Molten metal solidifies on the bolt; and, when the rod is pulled through die 15, the molten metal follows, solidifying on its way. After a solidified strand or rod 23 has been threaded through pinch rolls 25, the starter rod (with a small piece of the rod 23) is severed from the remainder of the rod or strand 23. A process for the continuous production of rod or strand is set forth in U.S. Pat. No. 4,211,270 entitled "Method of Continuous Casting of Metallic Strands at Exceptionally High Speed", issued July 8, 1980, the teachings of which are incorporated herein by reference. Once the rod or strand 23 has been formed from the melt 11, it is continuously withdrawn at a constant speed by one or more pairs of the pinch rollers 25. Thus, the rod 23 continuously advances away from the melt at a constant velocity as is shown by an arrow 27. While the rod 23 is advancing, the entire assembly 10 oscillates in the vertical direction. Basically, the assembly 10 is connected to a carriage assembly 14 for controlled oscillation.

As the chilled mold assembly 10 oscillates, it is cooled by means of coolant supplied to a manifold 24 through flexible tubes 26. The coolant delivery system is specifically described in conjunction with FIG. 4.

Figure 8:
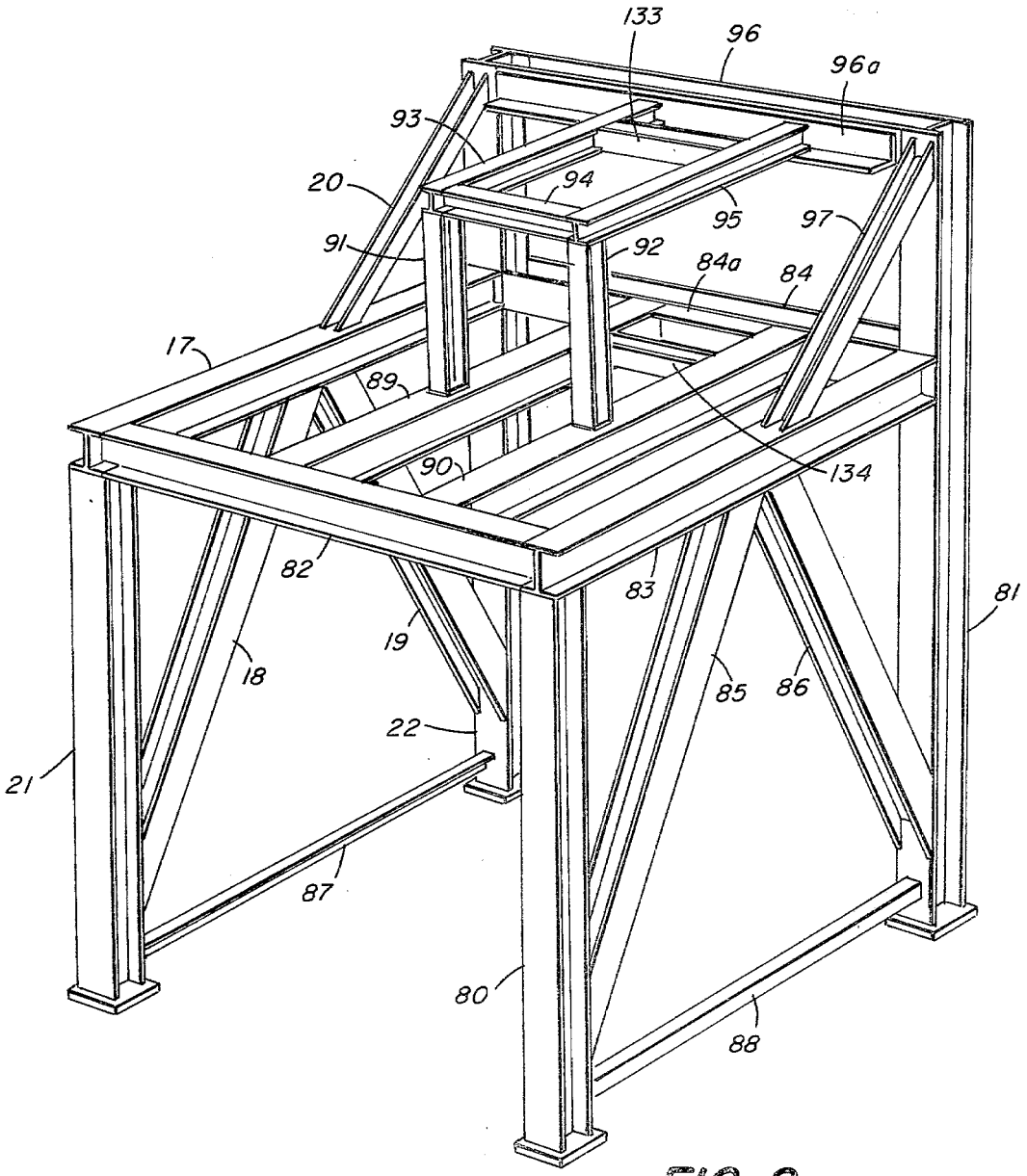
FIG. 8 is a perspective view of the structure for supporting the oscillating mold.

Because the mold assembly 10 oscillates during the casting process, high dynamic loads develop which must be accommodated by the supporting structure. The novel structural framing which resists these loads with a minimum of deflection will now be described in detail in conjunction with FIGS. 1 and 8. Referring first to FIG. 8, the overall supporting structure is a rigid steel box. The vertical loads are supported by the columnar structural members 21, 22, 80, 81 which are steel I-beams. The columnar members 21, 22, 80, 81 are tied together by the horizontal steel I-beams 17, 82, 83 and 84. The horizontal members 17, 82, 83, and 84 are preferably welded to the columnar members 21, 22, 80 and 81. The horizontal I-beams 17, 82, 83 and 84 are oriented so that their flange faces extend in the vertical direction for maximum stiffness in carrying the oscillation induced loads. The beam 84 is further stiffened by an angle piece **84*a* welded to the beam 84. The beams 17 and 83 are stiffened in the vertical direction by the bracing beams 18, 19, 85 and 86 which are also made of steel. Steel beams 87 and 88** further strengthen the structure at its bottom.

Carriage structure is mounted to beams **96*a* and 84*a* which totally support the carriage through beams 84 and 96. Carriage load paths are fed to the frame base through beams 20, 97, 85, 86, 18 and 19. The steel I-beams 89 and 90 are welded between the horizontal beams 82 and 84. These beams 89 and 90 support the oscillating carriage supporting superstructure comprising vertical I-beams 91 and 92 and horizontal I-beams 93, 94 and 95. The beams 93 and 95 are welded to a steel I-beam 96 which connects the columnar beams 81 and 22 at their tops. The beam 96 is stiffened by angle piece 96*a* attached to the front of the beam 96. The structure is rendered more rigid by bracing steel I-beams 20 and 97**.

The structural members in this embodiment are selected so that the whole support assembly has vibratory natural frequencies well above both the frequency of oscillation of carriage assembly 14 (FIG. 1) and the hydraulic actuation system so that the mold oscillation will not induce large amplitude vibrations in the supporting structure. Such vibrations would degrade the quality of the cast rod 23.

Figure 9:
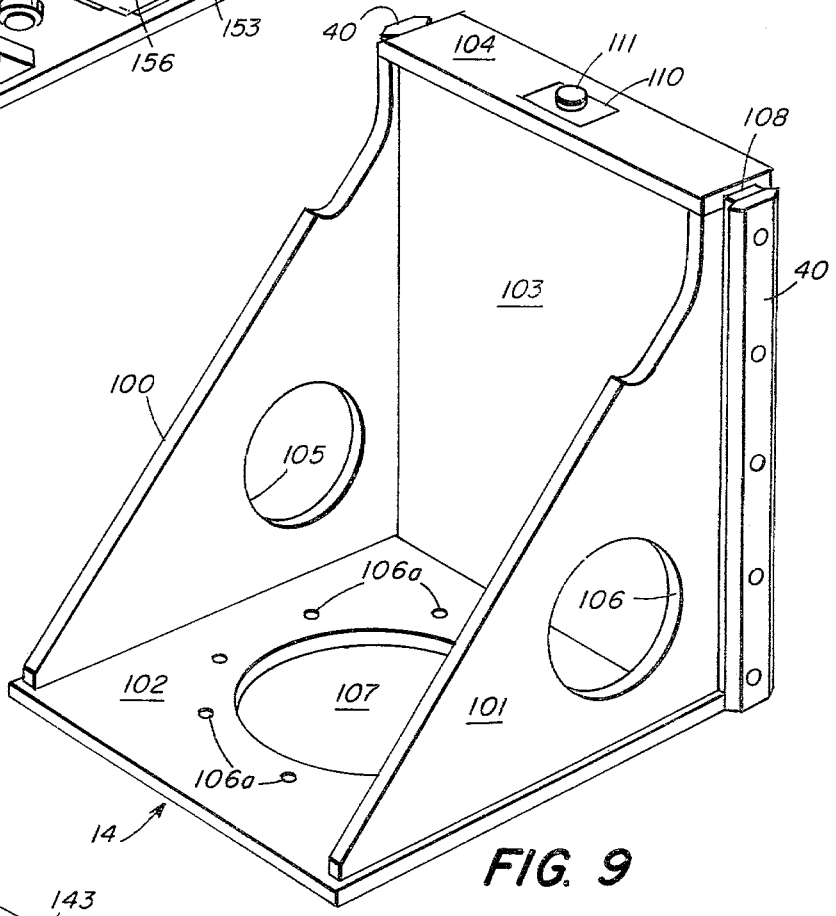
FIG. 9 is a perspective view of the carriage which supports a mold for oscillation.

The carriage assembly 14 (FIG. 1) is shown in greater detail in FIG. 9. This assembly 14 is constructed of steel angle plates 100 and 101 welded to bottom plate 102 and back plate 103. A top plate 104 is welded to the back plate 103 and the angle plates 100 and 101 to complete the structure. The plates 100 and 101, approximately one inch thick are lightened by means of holes 105 and 106 in the angle plates 100 and 101 respectively.

The carriage assembly 14 supports the manifold 24 (FIG. 1) by means of bolts through the bolt holes **106*a* which encircle a hole 107 in the bottom plate 102. The hole 107 allows the cast rod to pass through on its way to the pinch rollers 25** (FIG. 1).

Figure 2:
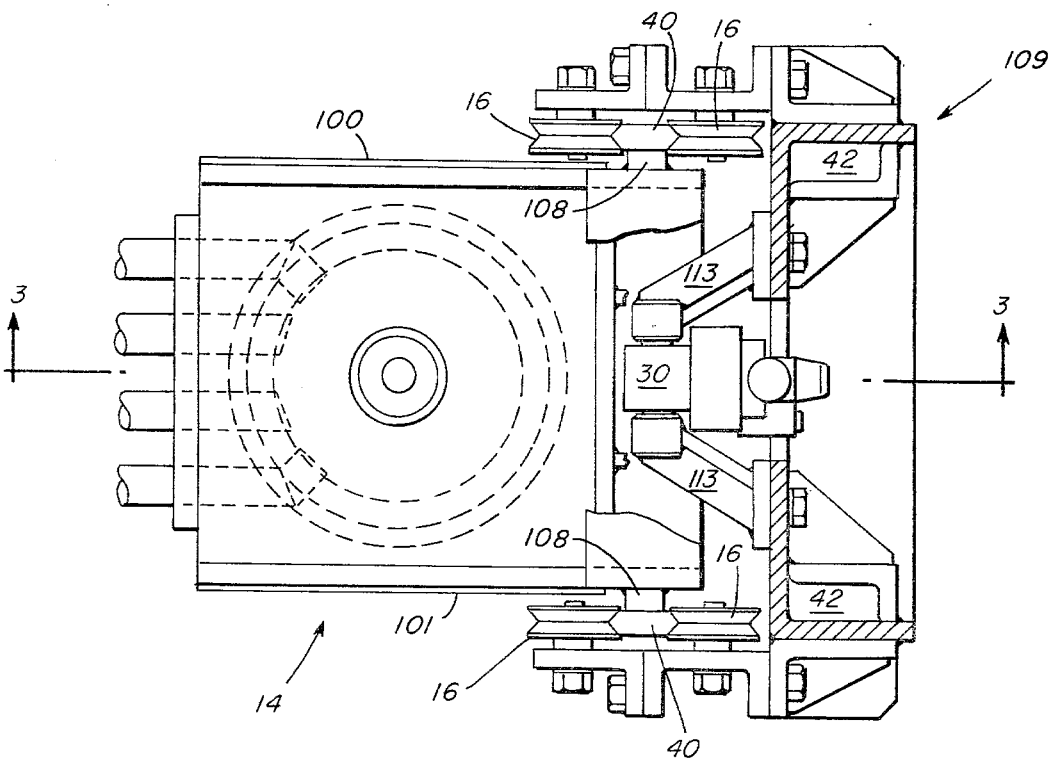
FIG. 2 is an isolated plan view of the carriage assembly of the structure of FIG. 1 for supporting and moving the oscillating mold.

Referring now to FIGS. 2 and 9, the carriage assembly 14 is constrained to move in the vertical direction by rails 40. These rails 40 are spaced apart from the angle plates 100 and 101 by means of spacers 108 and then the rails 40 and spacers 108 are bolted and doweled to the angle plates 100 and 101.

The rails 40 have bevelled edges which closely engage bevelled idler rollers 16. The rollers 16 are bolted to structural assembly 109. The structural assembly 109 includes welded box structures 42 for added rigidity.

The structural assembly 109 is bolted rigidly to the superstructure described above in reference to FIG. 8.

The top plate 104 (FIG. 9) has attached to it a striker plate 110 supporting a bumper 111 preferably made of a hard elastomeric material. The bumper 111 engages a hydraulic energy absorbing piston/cylinder assembly (to be described below in conjunction with FIGS. 10, 11 and 12) in the event that a malfunction results in the carriage 14 travelling beyond its intended range of travel.

Figure 3:
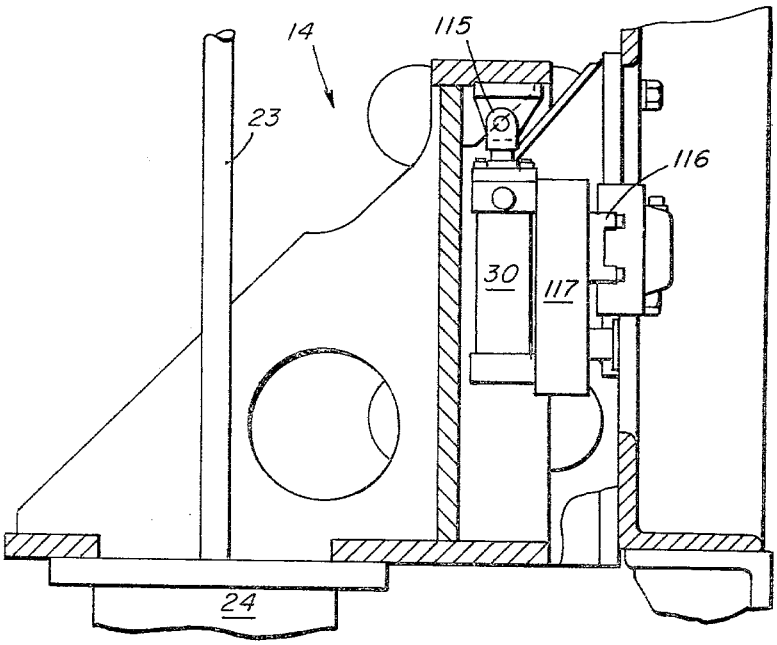
FIG. 3 is a side elevational view of the carriage assembly of FIG. 2.

With reference to FIGS. 2 and 3, the carriage assembly 14 is supported for oscillation in the vertical direction by hydraulic cylinder 30. The piston within the hydraulic cylinder 30 attaches to the top plate of carriage assembly 14 by means of bracket 115. The hydraulic cylinder 30 is controlled by servo valve 116 through manifold block 117.

The hydraulic cylinder 30 itself is supported by arms 113 (FIG. 2) which are bolted to the structural assembly 109. The servo valve 116 is under the control of a computer (not shown) which commands the desired relative motion between rod and mold for proper solidification of the cast rod. In particular, mold oscillation will create the same effect with respect to the rod or strand 23 as a pattern of forward and reverse strokes of the rod or strand itself.

Figure 7:
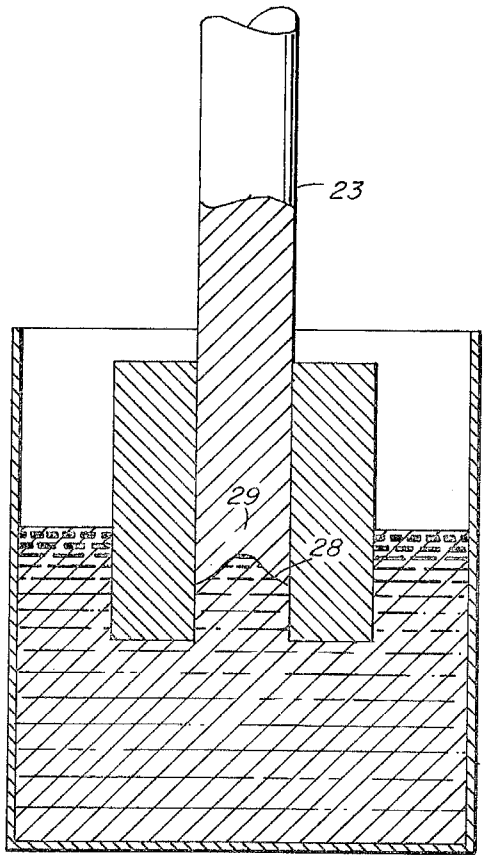
FIGS. 5–7 are diagrammatic representations of the position of the mold in a melt during various stages of mold oscillation.
Figure 6:
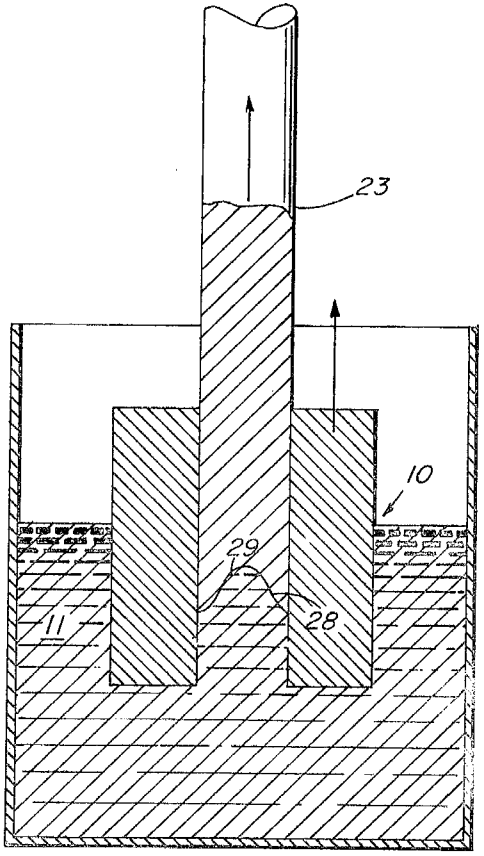
Figure 5:
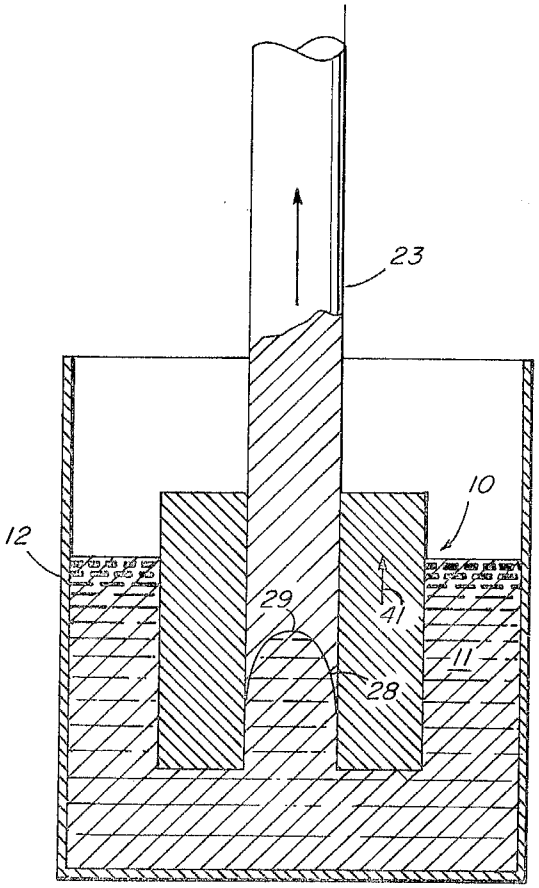

FIGS. 5–7 are provided to show the effect of mold oscillation on casting skin formation and to provide reference for the terms "forward" and "reverse" strokes. FIG. 5 shows the mold assembly 10 at its lowest point in the melt 11. At this instant in time, the mold assembly would be just beginning its acceleration in the upward direction as is indicated by this small arrow 41. At this time, the upward velocity of the strand would be greater than the upward or forward velocity of the mold. It should be noted that the solidification skin 28 of rod 23 is very thin. FIG. 6 shows the mold assembly 10 at about the middle of its travels up and down the melt. By the time the mold assembly has reached mid-point, its upward velocity is greater than the upward velocity of the strand. This is due to an acceleration of the mold assembly in the upward direction which is about 2 g for most applications. It is again emphasized that the velocity of the strand is constant and only the velocity of the mold assembly varies. In FIG. 6 the solidification front 29 has moved near the top of the melt. Skin 28 is thicker as opposed to the skin shown in FIG. 5.

FIG. 7 shows the mold at the top of its path of travel. At the particular instant depicted in FIG. 7, the mold velocity in the upward or forward direction is zero and is about to begin its trip back down to the position shown in FIG. 5. At this position, the solidification skin 28 is thickest. Forward and reverse speeds are separately settable in the computer to obtain optimum surface quality and material structure. In view of FIGS. 5–7 it should be apparent that the term "forward stroke" refers to the movement of the mold assembly away from the melt while the term "reverse stroke" refers to the movement of the mold assembly further into the melt.

Figure 4:
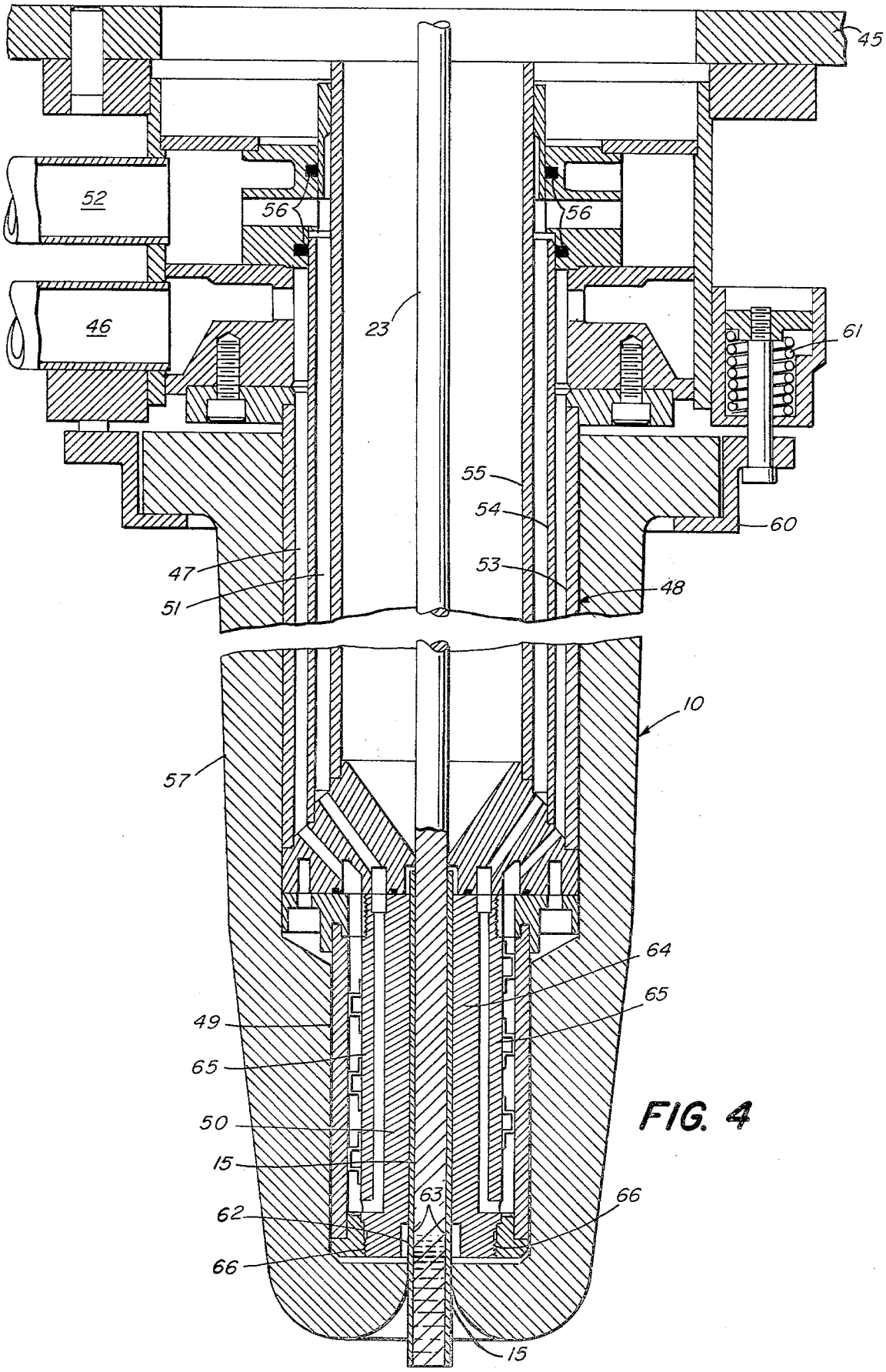
FIG. 4 is an isolated sectional view of the support manifold extension assembly and cooler mold of the structure of FIG. 1.

FIG. 4 shows how coolant is supplied continuously to the chilled mold assembly 10. Coolant, preferably water, enters a manifold 45 at an inlet 46 and travels down an annular passageway 47 in a manifold extension assembly 48 and continues into a coolerbody 49 to cool a mold 50. The coolant returns through an annular passageway 51 and out an outlet 52. The passageways 47 and 51 are the annular spaces created by three concentric tubes 53, 54 and 55 each formed of steel. The outer tube 53 is flange mounted to the manifold 45. The two inner tubes 54 and 55 slide into O-ring gland seals 56 in manifold 45. By this arrangement, dimensional changes caused by thermal gradients are accommodated.

The concentric tube design for the manifold extension assembly 48 permits high coolant flow rates while minimizing the cross sectional area of the assembly which must oscillate within the furnace melt. Minimizing the cross sectional area is important in holding down the hydrodynamic loading on the oscillating mold assembly.

A ceramic hat 57 surrounds the cooler body 49 and the manifold extension assembly 48 to insulate them thermally from the metallic melt so that the coolerbody may perform its function of cooling the mold so that rod solidification may occur. The hat 57 attaches to support the manifold 45 by means of a ring 60 which is spring biased against the manifold 45 by a spring 61. By this means of attachment the hat 57 is pulled tightly against the coolerbody 49 while allowing for dimensional changes from differential thermal expansion. The spring 61 is preloaded to create a total force greater than the highest G loading to be experienced during oscillation, thereby maintaining a tight seal between the hat 57 and the coolerbody 49.

The coolerbody 49 has a high cooling rate that produces a solidification front within a casting zone of the die 15 spaced from the die end adjacent the melt. The coolerbody, shielded by insulating hat 57, is at least partially immersed in the melt. Preferably it is deeply immersed with the level of the melt above the casting zone.

An insulating member 62 that extends toward the melt from a point just below the casting zone controls the radial thermal expansion of the die to ensure that the casting occurs in a dimensionally uniform section of the die and to control bellmouthing of the die end near the melt. In operation, the melt 11 begins to solidify into the strand 23 within the area of the die 15 backed by the insulating member 62. The insulating member 62 also provides a steep temperature gradient at the lower end of the casting zone which is conducive to a rapid cooling over a short length of the die. In FIG. 4, the solidification front is shown by front 63. In a preferred form, the die 15 projects into the melt from the lower end of the coolerbody to avoid drawing foreign materials into the casting zone. The insulating member 62 is a bushing of a low thermal expansion, low porosity, refractory material such as silica held around the die in a counterbore formed in the coolerbody. The die 15 is preferably formed of graphite or boron nitride.

The die 15 preferably has a longitudinally uniform cross section. The die can have a slight upwardly narrowing taper or stepped configuration on its inner surface. The die 15 is preferably slip fit into the coolerbody 49 to facilitate replacement. Before the die expands thermally against the coolerbody, it is restrained against axial movement by a slight upset in the mating coolerbody wall and a stepped outer surface that engages the lower face of the coolerbody. Also in the preferred form, a metallic foil sleeve is interposed between the outside insulating member 62 and the counterbore to facilitate removal of the insulator 62.

The coolerbody preferably has a double wall construction with an annular space between the walls. The inner wall 64 adjacent the die is preferably formed from a sound ingot of age hardened chrome copper alloy; the outer sleeve 65 is preferably formed of stainless steel. The inner and outer walls are preferably bonded at their lower ends by a copper/gold braze joint 66. Water is typically circulated in a temperature range and flow rate that yields a high cooling rate of the melt advancing through the die while avoiding condensation of water vapor on the mold assembly or the casting. A vapor shield and gaskets are preferably disposed between the immersed end of the coolerbody and the surrounding insulating hat.

The relatively massive oscillating mold disclosed herein, driven by a hydraulic actuator under the control of a servo valve, is susceptible to uncontrolled limit conditions which can drive the moving mass beyond its designed-for range of excursion thereby seriously damaging the apparatus. Such an event can happen, for example, if the servo valve seizes because of contamination or if an erroneous command is applied to the servo valve. An important part of this invention, therefore, is a novel snubbing system capable of bringing the moving mass to a non-destructive stop before the hydraulic actuator reaches the end of its travel on either end of its stroke.

Figure 10:
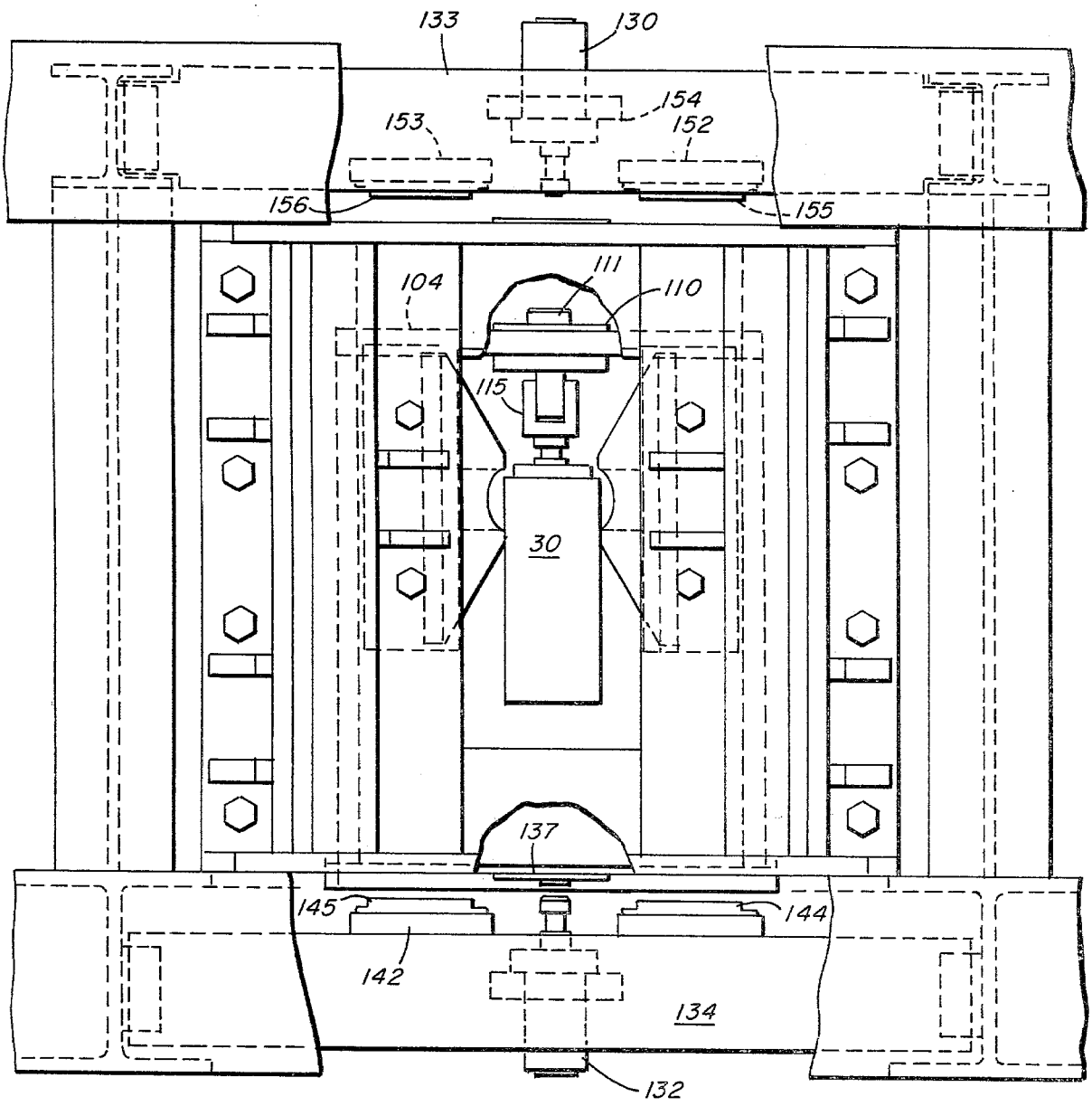
FIG. 10 is an elevation view of the caster disclosed herein showing the snubbing assembly.

The snubber system disclosed herein will be described with reference to FIGS. 1, 8, 9, 10, 11 and 12. Referring first to FIG. 9, the top plate 104 of the carriage assembly 14 carries the striker plate 110. Mounted on the striker plate 110 is the bumper 111, made of a hard elastomeric material such as polyurethane. There are a corresponding striker plate and bumper (neither shown in FIG. 9) mounted on the underside of the bottom plate 102. The bumper 111 is located to engage an upper hydraulic shock absorber 130 (FIG. 10) mounted in a top snubber assembly 133. Likewise a bottom bumper 131 is located to engage a lower hydraulic shock absorber 132. The hydraulic shock absorbers 130 and 132 are mounted within snubber assemblies 133 and 134 respectively. As can be seen in FIGS. 1, 8, and 10, these snubber assemblies 133 and 134 are mounted on the main supporting structure. With reference specifically to FIG. 8, the upper snubber assembly 133 is mounted between the steel I-beams 93 and 95, and the lower snubber assembly 134 is mounted between the beams 89 and 90.

Figure 12:
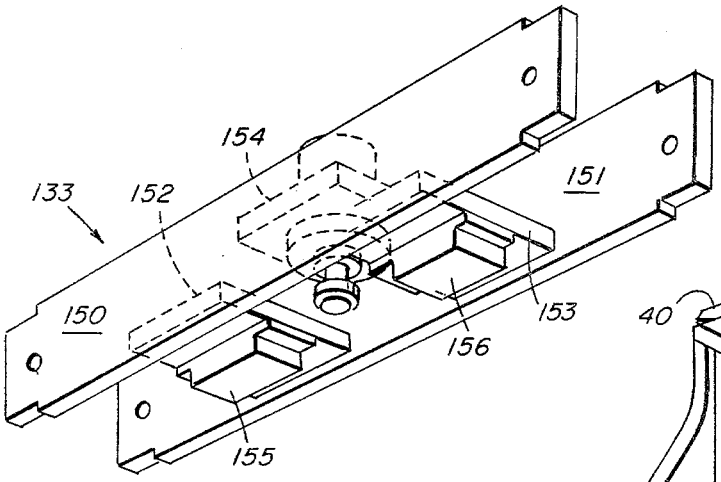
FIG. 12 is a perspective view of the top snubber assembly.
Figure 11:
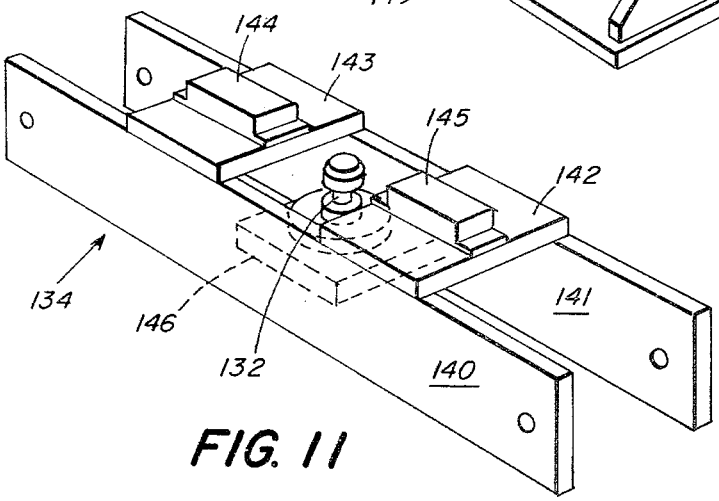
FIG. 11 is a perspective view of the bottom snubber assembly.

Referring now to FIGS. 11 and 12, the snubber assemblies 133 and 134 are shown. The lower snubber assembly 134 (FIG. 11) comprises spaced apart steel plates 140 and 141 supporting on their upper edges striker plates 142 and 143. Mounted on the striker plates 142 and 143 are elastomeric bumpers 144 and 145. Located between the plates 140 and 141 is a hydraulic shock absorber mounting plate 146 having a recess adapted for holding the hydraulic shock absorber 132.

The upper snubber assembly 133 (FIG. 12) is similarly constructed of two spaced apart steel plates 150 and 151 with striker plates 152, 153 and a hydraulic shock absorber mounting plate 154 supported between the plates 150 and 151. The striker plates 152 and 153 are adapted to receive elastomeric bumpers 155 and 156. The ends of the plates 150 and 151 are notched so as to fit within the flanges of the supporting beams 93 and 95 as shown in FIG. 8. Note that the ends of the plates 140 and 141 of the lower snubber assembly 134 (FIG. 11) are not notched because the beams 89 and 90 (FIG. 8) which support the lower snubber assembly 134 have sufficiently wide flanges to accommodate unnotched beams.

The hydraulic shock absorbers 130 and 132 (FIG. 10) have approximately one inch of travel. For the first one-half inch of travel, hydraulic fluid is forced through orifices (not shown) of varying sizes to absorb all of the propulsion energy and most of the oscillating mold assembly's kinetic energy. For the remainder of the stroke, the effective orifice area is constant. In addition, for the last one-half inch of travel, any remaining kinetic energy is absorbed by the elastomeric bumpers 144 and 145 (FIGS. 10 and 11) of the lower snubber assembly 134 and the corresponding bumpers 155 and 156 on upper snubber assembly 133 (FIGS. 10 and 12). The energy absorbing characteristics of the hydraulic shock absorbers 130 and 132 and the elastomeric bumpers 144, 145, 155 and 156 are selected so that the peak loads induced by the snubbing system are below the level which would fracture the ceramic insulating hat 57 (FIG. 4).

The melt 11 (FIG. 1) is produced in one or several melt furnaces (not shown) or in one combination melting and holding furnace (not shown). While this invention is suitable for producing continuous strands formed from a variety of metals and alloys, it is particularly directed to the production of copper alloy strands, especially brass. Referring again to FIG. 1, a ladle (not shown) carried by an overhead crane (not shown) transfers the melt from the melt furnace to the casting furnace 12. The ladle preferably has a teapot-type spout which delivers the melt with a minimum of foreign material such as cover and dross. To facilitate the transfer, the ladle is pivotally seated in support cradle on a casting platform. A ceramic pouring cup funnels the melt from the ladle to the interior of the casting furnace 12. The output end of the pouring cup is located below the casting furnace cover and at a point spaced from the mold assemblies. In continuous production, as opposed to batch casting, additional melt is added to the casting furnace when it is approximately half full to blend the melt both chemically and thermally.

The casting furnace 12 (FIG. 1) is supported on a hydraulic, scissor-type elevator and dolly assembly 125 that includes a set of load cells (not shown) to sense the weight of the casting furnace and its contents. Output signals of the load cells are conditioned to control the furnace elevation; this allows automatic control of the level of the melt with respect to the coolerbody. The casting furnace 12 is movable between a lower limit position in which the mold assembly is spaced above the upper surface of the melt when the casting furnace is filled and an upper limit position in which the mold assemblies are adjacent the bottom of the casting furnace. The height of the casting furnace is continuously adjusted during casting to maintain the selected immersion depth of the mold assembly in the melt. In the lowered position, the mold assemblies are accessible for replacement or servicing, after the furnace is rolled out of the way.

It should be noted that a production facility usually includes back-up level controls such as probes, floats, and periodic manual measurement as with a dunked wire. These or other conventional level measurement and control systems can also be used instead of the load cells as the primary system for maintaining the proper furnace height. Also, while this invention is described with reference to an oscillating mold assembly and a movable casting furnace, other arrangements can be used. The furnace can be held at the same level and melt added periodically or continuously to maintain the same level. Another alternative includes a very deep immersion so that level control is not necessary. A significant advantage of this invention is that it allows this deep immersion. Each of these arrangements has advantages and disadvantages that are readily apparent to those skilled in the art.

The casting furnace 12 is a 38-inch coreless induction furnace with a rammed alumina lining heated by a power supply. A furnace of this size and type can hold approximately five tons of melt. The furnace 12 has a pour-off spout that feeds to an overfill and pour-off ladle.

A withdrawal machine has opposed pairs of drive rolls 25 that frictionally engage the strand 23. The rolls are secured on a common shaft driven by a servo-controlled, reversible hydraulic motor. A conventional variable-volume, constant-pressure hydraulic pumping unit that generates pressures of up to 3000 psi drives the motor.

It should be noted that while this invention is described with respect to a preferred upward casting direction, it can also be used for horizontal and downward casting. Therefore, it will be understood that the term "lower" means proximate the melt and the term "upper" means distal from the melt. In downcasting, for example, the "lower" end of the mold assembly will in fact be above the "upper" end.

The die 15 (FIGS. 1 and 4) is formed of a refractory material that is substantially non-reactive with metallic and other vapors present in the casting environment especially at temperatures in excess of 2000° F. Graphite is the usual die material although good results have also been obtained with boron nitride. More specifically, a graphite sold by the Poco Graphite Company under the trade designation DFP-3 has been found to exhibit unusually good thermal characteristics and durability. Regardless of the choice of material for the die, before installation it is preferably outgassed in a vacuum furnace to remove volatiles that can react with the melt to cause start-up failure or produce surface defects on the casting. The vacuum also prevents oxidation of the graphite at the high outgassing temperatures, e.g. 750° F. for 90 minutes in a roughing pump vacuum. It will be understood by those skilled in the art that the other components of the mold assembly must also be freed of volatiles, especially water prior to use. Components formed of Fiberfrax refractory material are heated to about 1500° F.; other components such as those formed of silica are typically heated to 350° F. to 400° F.

The die 15 has a generally tubular configuration with a uniform inner bore diameter and a substantially uniform wall thickness. The inner surface of the die is highly smooth to present a low frictional resistance to the axial or longitudinal movement of the casting through the die and to reduce wear. The outer surface of the die, also smooth, is in pressured contact with the surrounding inner surface of the coolerbody during operation. The surface constrains the liner as it attempts to expand radially due to heating by the melt and the casting and promotes a highly efficient heat transfer from the die to the coolerbody by the resulting pressured contact.

The fit between the die and the coolerbody is important since a poor fit, one leaving gaps, severely limits heat transfer from the die to the coolerbody. A tight fit is also important to restrain longitudinal movement of the die with respect to the coolerbody due to friction or "drag" between the casting and the die as the casting is drawn through the die. On the other hand, the die should be quickly and conveniently removable from the coolerbody when it becomes damaged or worn. It has been found that all of these objectives are achieved by machining the mating surfaces of the die and coolerbody to close tolerances that permit a "slip fit" that is, an axial sliding insertion and removal of the die. The dimensions forming the die and mating surface are selected so that the thermal expansion of the die during casting creates a tight fit. While the die material typically has a much lower thermal expansion coefficient ($5\times10^{-6}$ in./in./°F.) than the coolerbody, ($10\times10^{-6}$ in./in./°F.) the die is much hotter than the coolerbody so that the temperature difference more than compensates for the differences in the thermal expansion coefficients. The average temperature of the die in the casting zone through its thickness is believed to be approximately 1000° F. for a melt at 2000° F. The coolerbody is near the temperature of the coolant, usually 80° to 100° F., circulating through it.

Mechanical restraint is used to hold the die in the coolerbody during low speed operation or set-up prior to its being thermally expanded by the melt. A straightforward restraining member such as a screw or retainer plate has proven impractical because the member is cooled by the coolerbody and therefore condenses and collects metallic vapors. This metal deposit can create surface defects in the casting and/or weld the restraining member in place which greatly impedes replacement of the die. Zinc vapor present in the casting of brass is particularly troublesome. An acceptable solution is to create a small upset or irregularity on the inner surface of the coolerbody, for example, by raising a burr with a nail set. A small step formed on the outer surface of the die which engages the lower face of the coolerbody (or more specifically, an "outside" insulating bushing or ring seated in counterbore formed in the lower end of the coolerbody) indexes the die for set-up and provides additional upward constraint against any irregular high forces that may occur such as during start-up. It should also be noted that the one-piece construction of the die eliminates joints, particularly joints between different materials, which can collect condensed vapors or promote their passage to other surfaces. Also, a one-piece die is more readily replaced and restrained than a multi-section die.

Alternative arrangements for establishing a suitable tight-fitting relationship beteen the die and coolerbody include conventional press or thermal fits. In a press fit, a molybdenum sulfide lubricant is used on the outside surface of the die to reduce the likelihood of fracturing the die during press fitting. The lubricant also fills machining scratches on the die. In the thermal fit, the coolerbody is expanded by heating, the die is inserted and the close fit is established as the assembly cools. Both the press fit and the thermal fit, however, require that the entire mold assembly be removed from the cooling water manifold to carry out the replacement of a die. This is clearly more time consuming, inconvenient and costly than the slip fit.

While the preferred form of the invention utilizes a one-piece die with a uniform bore diameter, it is also possible to use a die with a tapered or stepped inner surface that narrows in the upward direction or a multi-section die formed of two or more pieces in end-abutting relationship. Upward narrowing is desirable to compensate for contraction of the casting as it cools. Close contact with the casting over the full length of the die increases the cooling efficiency of the mold assembly. Increased cooling is significant because it helps to avoid a central cavity caused by an unfed shrinkage of the molten center of the casting.

It is thus seen that the objects of this invention have been achieved in that there has been disclosed a novel oscillating mold casting apparatus for the production of high quality rod which is cooled continuously as the mold oscillates and which moves in substantially the same direction as the rod being cast with little or no lateral movement and with a minimum of vibratory mode excitation. Furthermore, the unique coolant delivery system configuration holds down the hydrodynamic loading during mold assembly oscillation and the thermal and inertial stresses associated with oscillation within a melt are accommodated.

The invention is further illustrated by the following non-limiting example.

Using the apparatus illustrated in FIG. 1 of the drawing, a rod 23 was continuously cast from a melt 11 of freecutting brass, CDA 360. 4400 lbs. of the molten alloy was charged into furnace 12 and was maintained in the molten state. The composition for alloy CDA 360 is:

| | Weight Percent |
|---|---|
| Lead | 2.5–3.7 |
| Copper | 60.0–63.0 |
| Iron | 0–0.35 |
| Impurities | 0–0.5 |
| Zinc | balance |

After initiating casting of a rod 23 by insertion of a pipe with a screw on its end through die 15 into the melt 12 followed by withdrawal of the pipe in the manner known in this art, the solidified rod 23 was drawn by rollers 25 at a speed of 200 inches per minute. At the initiation of continuous withdrawal of rod 23, the body 10 of the oscillating mold was immersed in the melt 11 to a depth of about 5 inches. During casting, the dunk depth of body 10 varied from approximately 7 inches to 3 inches immersion. During mold oscillation, the temperature of the melt 11 was maintained at 1850° F. and molten alloy was fed into furnace 12 as needed during casting to maintain the immersion depths of body 10. The diameter of the die 15 was 0.75 inches to produce a rod 23 with a diameter of about 0.75 inches. The forward and reverse mold speed during oscillation reached a top value of 4 inches per second due to a mold acceleration of 1 g. The distance the mold travelled between its uppermost position in the melt and its bottommost position was approximately 1.75 inches. The temperature of the rod 23 as it left the die 15 was approximately 1500° F.

After casting, the rod was hot fabricated successfully. Cast grain size was from columnar, $<1$ mm. Wrought structure was fine recrystallized throughout the section (0.025–0.050 mm).

Although the invention disclosed herein has been described with reference to its preferred embodiments, it is to be understood that modifications and variations will occur to those skilled in the art. Such modifications and variations are intended to fall within the scope of the appended claims.

What is claimed is:

1. An apparatus for the continuous casting of metal rod comprising:

a support structure for supporting an oscillating mold assembly;

a vessel containing a metallic melt;

an oscillating mold assembly including:

(1) a fluid coolable mold asembly in communication with said metallic melt for the continuous formation of a cast rod from said melt, (2) a movable carriage assembly for supporting said mold assembly, said carriage assembly being constrained to move in the same and reverse direction as a rod being continuously cast, (3) means for oscillating said carriage assembly and thus oscillate the mold assembly in the same direction and in a reverse direction of a rod being cast, said means for oscillating said carriage assembly including at least one rail oriented in the same direction as the rod to be cast and at least one roller which engages said rail, said combination of at least one roller and at least one rail being the means by which said oscillating mold assembly is movably supported by said support structure, and, (4) a hydraulic cylinder having a piston with said hydraulic cylinder being supported by said support structure and said piston being connected to said carriage assembly so that movement of the piston is transmitted to the carriage assembly to cause the carriage assembly to oscillate along said at least one rail;

means for drawing the metallic melt through said mold assembly to continuously produce a rod; and, means for delivering a coolant to said mold assembly while said mold assembly is oscillating.

2. The apparatus as set forth in claim 1 wherein said mold assembly comprises:

a mold;

a coolerbody surrounding said mold;

a coolant manifold extension assembly communicating with and supplying coolant to said coolerbody; and, a support manifold disposed to support said manifold extension assembly, said support manifold adapted for supplying said coolant to said coolant manifold extension assembly.

3. The apparatus as set forth in claim 2 wherein said manifold extension assembly comprises three concentric tubes forming two annular elongated passageways therebetween, one of said annular passageways being adapted for supplying said coolant to said coolerbody and the other of said annular passageways being adapted for receiving said coolant from said coolerbody.

4. The apparatus as set forth in claim 2 wherein an insulating hat surrounds said coolerbody and said manifold extension assembly.

5. The apparatus as set forth in claim 3 wherein an insulating hat surrounds said coolerbody and said manifold extension assembly.

6. The apparatus as set forth in claim 1 including a servo valve for controlling said hydraulic cylinder.

7. The apparatus as set forth in claim 2 including a servo valve for controlling said hydraulic cylinder.

8. The apparatus as set forth in claim 3 including a servo valve for controlling said hydraulic cylinder.

9. The apparatus as set forth in claim 4 including a servo valve for controlling said hydraulic cylinder.

10. The apparatus as set forth in claim 5 including a servo valve for controlling said hydraulic cylinder.

11. The apparatus as set forth in claim 1 wherein said at least one rail is attached to said carriage assembly which engages said at least one roller attached to said support structure.

12. The apparatus as set forth in claim 2 wherein said at least one rail is attached to said carriage assembly which engages said at least one roller attached to said support structure.

13. The apparatus as set forth in claim 3 wherein said at least one rail is attached to said carriage assembly which engages said at least one roller attached to said support structure.

14. The apparatus as set forth in claim 4 wherein said at least one rail is attached to said carriage assembly which engages said at least one roller attached to said support structure.

15. The apparatus as set forth in claim 5 wherein said at least one rail is attached to said carriage assembly which engages said at least one roller attached to said support structure.

16. The apparatus as set forth in claim 1 wherein said support structure has vibratory natural frequencies substantially higher than the frequency of oscillation of said mold assembly.

17. The apparatus as set forth in claim 2 wherein said support structure has vibratory natural frequencies substantially higher than the frequency of oscillation of said mold assembly.

18. The apparatus as set forth in claim 3 wherein said support structure has vibratory natural frequencies substantially higher than the frequency of oscillation of said mold assembly.

19. The apparatus as set forth in claim 4 wherein said support structure has vibratory natural frequencies substantially higher than the frequency of oscillation of said mold assembly.

20. The apparatus as set forth in claim 5 wherein said support structure has vibratory natural frequencies substantially higher than the frequency of oscillation of said mold assembly.

21. The apparatus as set forth in claim 6 wherein said support structure has vibratory natural frequencies substantially higher than the frequency of oscillation of said mold assembly.

22. The apparatus as set forth in claim 7, wherein said support structure has vibratory natural frequencies substantially higher than the frequency of oscillation of said mold assembly.

23. The apparatus as set forth in claim 8 wherein said support structure has vibratory natural frequencies substantially higher than the frequency of oscillation of said mold assembly.

24. The apparatus as set forth in claim 9 wherein said support structure has vibratory natural frequencies substantially higher than the frequency of oscillation of said mold assembly.

25. The apparatus as set forth in claim 10 wherein said support structure has vibratory natural frequencies substantially higher than the frequency of oscillation of said mold assembly.

26. The apparatus as set forth in claim 11 wherein said support structure has vibratory natural frequencies substantially higher than the frequency of oscillation of said mold assembly.

27. The apparatus as set forth in claim 12 wherein said support structure has vibratory natural frequencies substantially higher than the frequency of oscillation of said mold assembly.

28. The apparatus as set forth in claim 13 wherein said support structure has vibratory natural frequencies substantially higher than the frequency of oscillation of said mold assembly.

29. The apparatus as set forth in claim 14 wherein said support structure has vibratory natural frequencies substantially higher than the frequency of oscillation of said mold assembly.

30. The apparatus as set forth in claim 15 wherein said support structure has vibratory natural frequencies substantially higher than the frequency of oscillation of said mold assembly.

31. The apparatus as set forth in claim 16 wherein said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

32. The apparatus as set forth in claim 17 wherein said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

33. The apparatus as set forth in claim 18 wherein said said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

34. The apparatus as set forth in claim 19 wherein said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

35. The apparatus as set forth in claim 20 wherein said said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

36. The apparatus as set forth in claim 21 wherein said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

37.

The apparatus as set forth in claim 22 wherein said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

38. The apparatus as set forth in claim 23 wherein said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

39. The apparatus as set forth in claim 24 wherein said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

40. The apparatus as set forth in claim 25 wherein said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

41. The apparatus as set forth in claim 26 wherein said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

42. The apparatus as set forth in claim 27 wherein said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

43. The apparatus as set forth in claim 28 wherein said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

44. The apparatus as set forth in claim 29 wherein said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

45. The apparatus as set forth in claim 30 wherein said support structure includes columnar structural members which are steel I-beams tied together by horizontal steel I-beams oriented so that their flange faces extend in the vertical direction for maximum stiffness in carrying the oscillation induced loads, said structural members being selected so that the whole support assembly has vibratory natural frequencies well above both the frequency of oscillation of carriage assembly and the hydraulic actuation system so that the mold oscillation will not induce large amplitude vibrations in the supporting structure.

46. The apparatus as set forth in claim 16 including a snubbing system capable of bringing the moving mass to a nondestructive stop before the hydraulic actuator reaches the end of its travel on either end of its stroke comprising a striker plate mounted on the carriage for engagement with a hydraulic shock absorber mounted on the supporting structure.

47. The apparatus as set forth in claim 46 also including elastomeric bumbers mounted on the supporting structure for contact with said carriage.

* * * * *